US006776243B2

(12) United States Patent
Pröls et al.

(10) Patent No.: US 6,776,243 B2
(45) Date of Patent: Aug. 17, 2004

(54) CARRYING HANDLE FOR A PERCUSSION POWER TOOL

(75) Inventors: Tim Pröls, Munich (DE); Konrad Artmann, Worthsee (DE); Martin Richter, Freising (DE)

(73) Assignee: Hilti Aktiengesellschaft, Schaan (LI)

( * ) Notice: Subject to any disclaimer, the term of this patent is extended or adjusted under 35 U.S.C. 154(b) by 22 days.

(21) Appl. No.: 10/162,790

(22) Filed: Jun. 5, 2002

(65) Prior Publication Data

US 2002/0185287 A1 Dec. 12, 2002

(30) Foreign Application Priority Data

Jun. 8, 2001 (DE) ..... 101 27 984

(51) Int. Cl.[7] ..... E21B 3/00

(52) U.S. Cl. ..... 173/162.2; 173/162.1; 173/170; 173/DIG. 2; 173/168

(58) Field of Search ..... 173/170, 162.2, 173/162.1, 210–211, 162, DIG. 2, 168; 279/19; 408/241, 57, 59

(56) References Cited

U.S. PATENT DOCUMENTS 4,081,038 A * 3/1978 Andersson et al. ..... 173/162.1
4,168,751 A * 9/1979 Deike ..... 173/1
4,303,131 A * 12/1981 Clark ..... 173/207
4,483,402 A * 11/1984 Vonhoff, Jr. ..... 173/207
5,431,235 A * 7/1995 Drumheller et al. ..... 173/211
5,450,911 A * 9/1995 Gustafsson ..... 173/211
6,484,361 B1 * 11/2002 Schmid et al. ..... 173/162.2

FOREIGN PATENT DOCUMENTS

| | | |
|---|---|---|
| DE | 449950 | 3/1926 |
| DE | 4020773 | 1/1992 |
| GB | 2040210 | 8/1980 |

* cited by examiner

*Primary Examiner*—Rinaldi I. Rada
*Assistant Examiner*—Michelle Lopez
(74) *Attorney, Agent, or Firm*—Sidley Austin Brown & Wood, LLP

(57) ABSTRACT

An assembly for a percussion power tool includes a carrying handle (5) and a flush head (4) which is connected with the power tool chuck (3) for flushing a working tool receivable in the chuck and which has an inlet opening (12) for a flushing fluid and communicating with the working tool stem (2), the carrying handle (5) and the flush head (4) forming a functional unit.

7 Claims, 1 Drawing Sheet

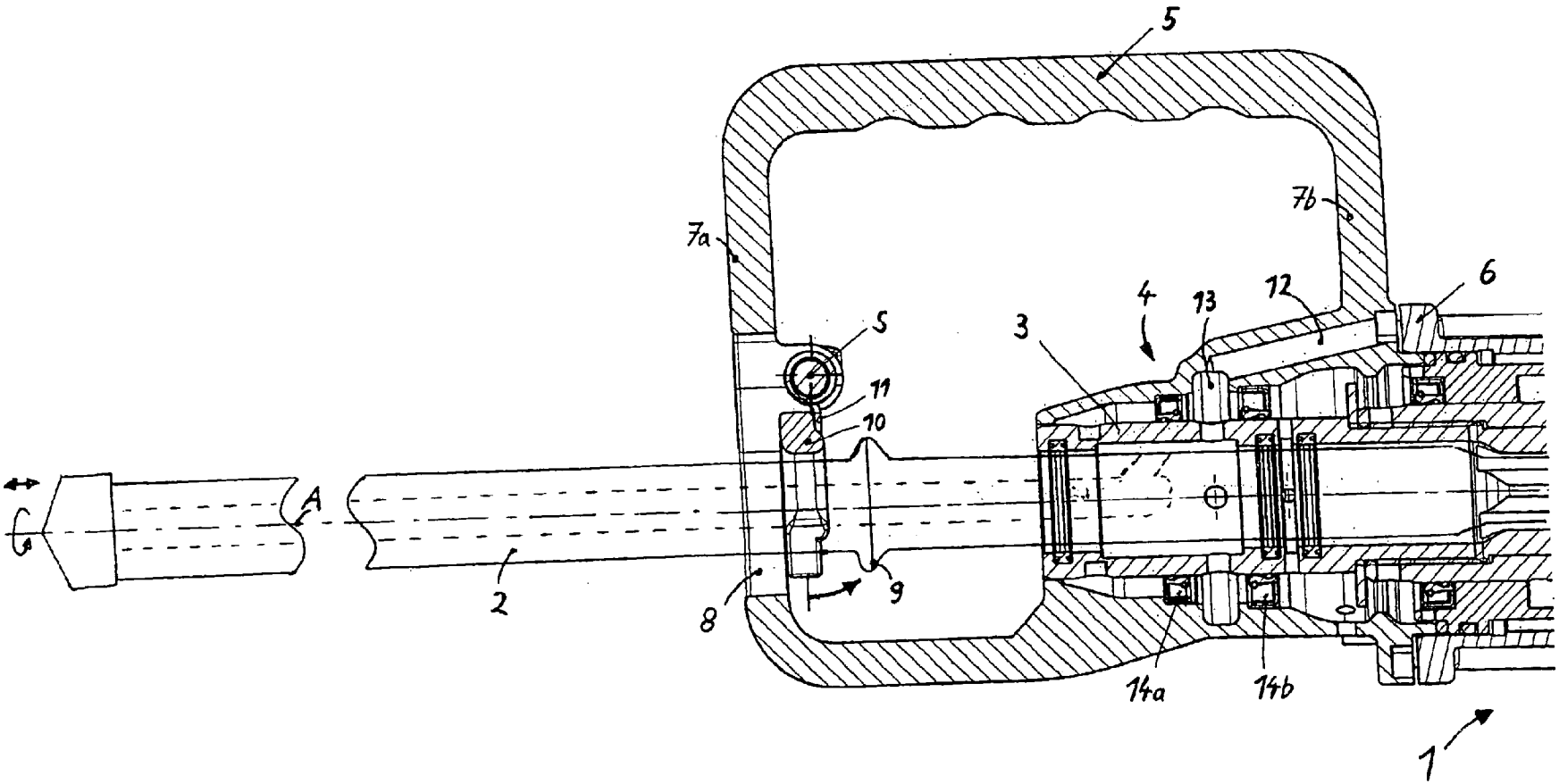
1
2
3
4
5
6
7a
7b
8
9
10
11
12
13
14a
14b

CARRYING HANDLE FOR A PERCUSSION POWER TOOL

BACKGROUND OF THE INVENTION

1. Field of the Invention

The present invention relates to a carrying handle for a percussion power tool such as a hammer drill or a chisel hammer.

2. Description of the Prior Art

High-power hammer drills or chisel hammers having a mass of more than 10 kg, such as used in the mining industry, usually are arranged, when used, on a bore support or a bore mount. Such power tools are designed for being carried by a person when carried from one site to another site. When used in the mining industry, the power tools are subjected to hard loads and have their bottom partially ground. The working tool, which is used with power tools of the type described above, has an axial flush channel extending at least partially along the working tool stem. The flush channel serves for conducting of cooling fluid and flushing medium such as, e.g., water, which is fed either centrally through the chuck or through a flush head that sealingly surrounds the working tool stem in the region of the flush opening of the tool stem.

European Publication EP-0 059 071 disclosed a percussion hand-held power tool in which a working tool, which is received in a chuck of the power tool with a possibility of a limited axial displacement and which has a circumferential band, is locked by a wire stirrup that is secured to the chuck.

U.S. Pat. No. 5,749,421 discloses a percussion power tool in which the working tool is axially locked by a pivotal, self-locking lever which is secured to the power tool chuck and the pivotal movement of which in the axial direction is limited. The lever has a radial stop nose that engages from beneath a circumferential band provided on the working tool. To this end, the sleeve-shaped chuck extends axially up to an area beneath the working tool band.

Swiss Pat. No. 613,393 discloses a hammer drill in which a hollow side handle, which also serves for the aspiration of dust, is air-tightly connected with a suction head that sealingly surrounds the working tool in the region of the suction opening.

U.S. Pat. No. 6,112,831 discloses a heavy chisel hammer with an offset handle frame the stirrup-shaped carrying handle of which extending transverse to the percussion direction above the hammer chuck, does not protect the bottom of the chuck from a contact with a support. At that, the handle frame that surrounds the power tool, is very bulky.

British Publication GB-2040210 discloses a wood chisel tool in which a side guide handle is provided on the chuck and which, in connection with a carrying stirrup, permits to suspend the chisel tool on the forearm of a user to be used for a one-arm operation. The guide handle does not protect the chuck. The guide handle is not suitable for carrying the chisel tool.

An object of the invention is to provide a multi-functional carrying handle for a heavy power tool and which is suitable for both, anatomically, for carrying the power tool and for protection of the bottom of the chuck from a direct contact with a support or a mount.

SUMMARY OF THE INVENTION

This and other objects of the present invention, which will become apparent hereinafter are achieved by providing an assembly including a flush head connectable with a chuck of a percussion power tool, and a carrying head that forms with the flush head a functional unit.

The carrying handle has a bottom that protects the chuck along its longitudinal extent from beneath and along which the chuck slides, whereby the chuck is protected at least from large contaminants.

Advantageously, the handle is formed as a stirrup-shaped closed handle, which makes it very stable and, thus, capable of withstanding of high loads.

The functional unit, which is formed of the carrying frame and the flush head, can be easily attached to the power tool housing, e.g., with screws.

Advantageously, the carrying handle extends in an direction toward the working tool tip and has both its legs arranged on the flush head. As a result, the force application point is located in front of the power tool which permits to carry the power tool, together with an elongate working tool, with one hand.

Advantageously, the front, in the direction toward the working tool tip, leg of the stirrup-shaped carrying handle has an eyelet through which the working tool stem, together with the circumferential band, can be inserted, with the handle extending parallel to the percussion axis of the power tool.

Advantageously, on the working tool side of the carrying handle, there is provided locking means for the working tool that is capable of a limited axial displacement. The locking takes place outside of the chuck which permits to arrange the flush head between the chuck and the locking means. A possible idle impact on the working tool stem would be transmitted via the handle and the flush head to the power tool housing and would be absorbed thereby.

Advantageously, the locking means is formed as a locking cup pivotable in a direction toward the power tool but a pivotal movement of which in opposite direction is limited by the carrying handle. The locking cup engages from beneath, with its edge, which is located adjacent to the percussion axis, the radially projecting band formed on the stem of the working tool, locking the working tool. Advantageously, there is provided a spring for preloading the locking cup, which insures an automatic locking of the working tool.

The flush head has an inlet opening for flushing fluid and oriented toward the power tool. The inlet opening opens into a circumferential groove formed in the chuck, with the chuck being sealed, on opposite axial sides of the groove, with coaxial seals. The chuck forms an annular or circumferential space in the axial region of which, a radial opening of the working tool that communicates with a flush channel formed in the stem, is located. The radial opening is likewise sealed on its opposite sides. This provides for feeding of the flush medium directly into the flush head and therefrom into the working tool stem and to the drilling head.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawing.

BRIEF DESCRIPTION OF THE DRAWINGS

In the Drawings:

FIG. 1 shows a cross-sectional view of a percussion power tool with a carrying handle according to the present invention.

DETAILED DESCRIPTION OF THE PREFERRED EMBODIMENT

According to the present invention, a chuck 3, which is provided at a tool side of the percussion power tool 1 for receiving a shank formed at a power tool side of a stem 2 of a conventional boring tool subjected to a percussion movement, is connected with a flush head 4 that forms a functional unit with a stirrup-shaped, closed carrying handle 5. The functional unit, which is formed of the flush head 4 and the carrying handle 5, can be easily attached to and detached from a housing 6 of the power tool by using screws. The stirrup-shaped, closed carrying handle 5 extends along a percussion axis A, projecting in a direction toward the tip of the boring tool, and has its both legs 7*a*, 7*b* secured to the flush head 4. The front, in the direction toward the tip of the boring tool, leg 7*a* of the stirrup-shaped carrying handle 5 forms a coaxial, with the stem 2, eyelet 8 through which the stem 2, together with a radially projecting band 9, extends. At the boring tool side of the carrying handle 5, there is provided locking means 10 that is formed as a locking cup. The locking means 10 is supported for a pivotal movement about a pivot axis 5, with the pivotal movement of the locking means 10 being limited in the direction toward the tip of the boring tool by the carrying handle 5 itself. The locking means 10 is preloaded against a pivotal movement by a spring 11. The flush head 4 has an inlet opening 12 for introducing a flush medium. The inlet opening 12 opens into a circumferential groove 13, with the chuck 3 being sealed, on opposite axial sides of the groove 13, with coaxial seals 14*a*, 14*b*. The chuck 3 forms a circumferential space in the axial region of which a radial opening of the working tool that communicates with a flush channel in the stem 2, is located and is likewise sealed on its opposite sides.

Though the present invention was shown and described with references to the preferred embodiment, such is merely illustrative of the present invention and is not to be construed as a limitation thereof, and various modifications to the present invention will be apparent to those skilled in the art. It is therefore not intended that the present invention be limited to the disclosed embodiment or details thereof, and the present invention includes all of variations and/or alternative embodiments within the spirit and scope of the present invention as defined by the appended claims.

What is claimed is:

1. An assembly for a percussion power tool (1) having a chuck (3) for receiving a working tool, the assembly comprising a flush head (4) connectable with the chuck (3) for flushing the working tool receivable in the chuck (3) and having an inlet opening for a flushing fluid and communicating with a flush channel of the working tool stem (2) via the chuck (3); a carrying handle (5) forming with the flush head (4) a functional unit, locking means (10) for the working tool that is capable of a limited axial movement, the locking means (10) being provided on a working tool side of the carrying handle (5).

2. An assembly according to claim 1, wherein the carrying handle is formed as a stirrup-shaped, closed carrying handle.

3. An assembly according to claim 2, wherein the functional unit, which is formed of the stirrup-shaped, closed carrying handle (5) and the flush head (4), is releasably attachable to a housing (6) of the power unit (1).

4. An assembly according to claim 2, wherein the stirrup-shaped, closed carrying handle extends along a percussion axis (A) of the power tool projecting in a direction toward the working tool tip, with both legs (7*a*, 7*b*) of the stirrup profile being arranged on the flush head (4).

5. An assembly as set forth in claim 4, wherein a front, in the direction toward the working tool tip, leg (7*a*) of the stirrup-shaped, closed carrying handle has a eyelet (8), through which the working tool stem (2), together with a radially projecting band (9) formed thereon, is insertable.

6. An assembly according to claim 1, wherein the locking means (10) is formed as a locking cup pivotable in a direction toward the power tool but a pivotal movement of which in opposite direction is limited by the carrying handle (5), the locking cup engaging from beneath, with an edge thereof, adjacent to the percussion axis (A), a radially projecting band (9) formed on the stem (2) of the working tool.

7. An assembly according to claim 6 further comprising a spring (11) for preloading the locking cup.

* * * * *